US009109587B2

(12) United States Patent
Adler et al.

(10) Patent No.: US 9,109,587 B2
(45) Date of Patent: Aug. 18, 2015

(54) MULTISTAGE PISTON COMPRESSOR

(75) Inventors: Robert Adler, Gerasdorf (AT); Martin Pfandl, Rust im Tullnerfeld (AT); Georg Siebert, Vienna (AT)

(73) Assignee: Linde Aktiengesellschaft, Munich (DE)

( * ) Notice: Subject to any disclaimer, the term of this patent is extended or adjusted under 35 U.S.C. 154(b) by 446 days.

(21) Appl. No.: 13/299,400

(22) Filed: Nov. 18, 2011

(65) Prior Publication Data

US 2012/0301328 A1 Nov. 29, 2012

(30) Foreign Application Priority Data

Dec. 1, 2010 (DE) ..... 10 2010 053 091

(51) Int. Cl.

| | |
|---|---|
| ***F04B 9/109*** | (2006.01) |
| ***F04B 9/10*** | (2006.01) |
| ***F04B 9/117*** | (2006.01) |
| ***F04B 39/00*** | (2006.01) |
| ***F04B 53/14*** | (2006.01) |
| ***F04B 3/00*** | (2006.01) |
| ***F04B 15/08*** | (2006.01) |
| ***F04B 23/06*** | (2006.01) |
| ***F04B 25/00*** | (2006.01) |
| ***F04B 41/06*** | (2006.01) |

(52) U.S. Cl.

CPC ..... *F04B 39/0011* (2013.01); *F04B 3/00* (2013.01); *F04B 9/1095* (2013.01); *F04B 9/117* (2013.01); *F04B 9/1176* (2013.01); *F04B 15/08* (2013.01); *F04B 23/06* (2013.01); *F04B 25/005* (2013.01); *F04B 41/06* (2013.01); *F04B 53/141* (2013.01); *F04B 53/142* (2013.01)

(58) Field of Classification Search

CPC ..... F04B 25/00; F04B 25/005; F04B 9/109; F04B 9/1095; F04B 9/117; F04B 9/1176; F04B 53/141; F04B 53/142; F04B 39/0011

USPC ..... 417/225, 226, 227, 246, 46, 49, 65, 92, 417/98, 103, 382, 383, 385–388, 390, 397, 417/212, 216; 60/592

See application file for complete search history.

(56) References Cited

U.S. PATENT DOCUMENTS

| | | | | |
|---|---|---|---|---|
| 1,757,782 | A * | 5/1930 | Schaer | 417/342 |
| 1,760,213 | A * | 5/1930 | Schaer | 60/544 |
| 1,767,404 | A * | 6/1930 | Schaer | 417/342 |
| 1,797,245 | A * | 3/1931 | Schaer | 417/387 |
| 5,477,690 | A * | 12/1995 | Gram | 62/45.1 |
| 6,640,556 | B2 * | 11/2003 | Ursan et al. | 62/50.6 |

FOREIGN PATENT DOCUMENTS

DE 102006042122 A1 3/2008

* cited by examiner

*Primary Examiner* — Peter J Bertheaud

(74) *Attorney, Agent, or Firm* — Philip H. Von Neida

(57) ABSTRACT

A multistage piston compressor for a gaseous or cryogenically liquefied medium with at least two compressor stages, which operatively interact with a shared drive train for purposes of joint powering, wherein each compressor stage exhibits a piston that is mechanically connected with the drive train, and arranged in a compressor cylinder so that it can longitudinally shift.

15 Claims, 2 Drawing Sheets

1
A
32A
33A
31
2A
VA
30A
31
55A
57A
41
40A
23A
10A
VA
9A
2A
50A
59A
22A
15

MULTISTAGE PISTON COMPRESSOR

CROSS REFERENCE TO RELATED APPLICATIONS

This application claims priority from German Patent Application Serial No. De 102010053091.3 filed Dec. 1, 2010.

BACKGROUND OF THE INVENTION

The invention relates to a multistage piston compressor for a gaseous or cryogenically liquefied medium with at least two compressor stages, which operatively interact with a shared drive train for purposes of joint powering, wherein each compressor stage exhibits a piston that is mechanically connected with the drive train, and arranged in a compressor cylinder so that it can longitudinally shift.

A generic, multistage piston compressor is known from 10 2006 042 122 A1.

Such compressors are used to compress gaseous or liquid media, such as hydrogen, nitrogen or natural gas in a gaseous or liquid state.

In generic, multistage compressors where the pistons of the individual compressor stages are connected with a shared drive train, and the pistons of the individual compressor stages are mechanically joined with the drive train, the pistons of the compressor stages are jointly powered by the drive train, and with the drive train actuated each perform a piston motion with a constant piston stroke. Each piston of the corresponding compressor stage is exposed to the pressure of the medium built up in the corresponding compressor stage. If a compressor stage concurrently operates without compressor power, for example in a partial load range or no-load state, the built up pressure of the medium on the concurrently operating piston executing the piston stroke creates an additional energy demand, which must be applied by way of the drive train to power the piston. In addition, the built up pressure causes the concurrently operating piston to place a load on the drive train, as a result of which a non-uniform load is placed on the drive train, especially during the partial load operation or no-load operation of a compressor stage. Furthermore, loads and mechanical wear arise on allocated components in the piston of a compressor stage concurrently operating under a partial or no load, for example on the sealing devices for sealing the piston in the compressor cylinder, the mounts of the piston as well as the suction valve and pressure valve of the medium to be compressed. In addition, the piston stroke motion of the concurrently operating piston of a compressor stage produces wear on the corresponding surfaces between the piston and compressor cylinder.

If the compressor stages in a generic, multistage compressor are connected in series as stage compressors, and the output side of a compressor stage is connected with the input of a next compressor stage, the result in a generic compressor in which the pistons of the compressor stages are coupled with a shared drive train and synchronously powered is that the input pressure range and compression ratio of the respective compressor stage are confined to a narrow range by the fixed and constant piston stroke by the piston of the corresponding compressor stage.

SUMMARY OF THE INVENTION

The object of the present invention is to provide a generic, multistage compressor in which the compressor stages can be operated independently of each other, and which is improved in terms of wear and energy efficiency.

This object is achieved according to the invention by virtue of the fact that the piston of the respective compressor stage is connected with a liquid column of an incompressible liquid situated in the compressor cylinder, which converts the piston stroke motion of the piston into a motion of a compressor piston arranged in the compressor cylinder so that it can longitudinally shift, wherein the liquid column for changing the compressor stroke of the compressor piston can be connected with an outlet. According to the invention, the piston of each compressor stage mechanically coupled with the drive train is hence connected by way of a liquid column of an incompressible liquid, for example a hydraulic fluid, with a compressor piston, which executes the corresponding compressor stroke for compressing the medium to be compressed. The liquid column of each compressor stage can be altered and varied in a manner according to the invention by connecting the liquid column with an outlet, so that given a constant piston stroke of the piston mechanically powered by the drive train, the compressor stroke of the compressor piston allocated to the piston can be controlled independently of the piston stroke. This makes it possible to partially or completely deactivate a compressor piston even though the piston is powered, and thereby shut down and immobilize the compressor piston or control it in the compressor stroke. In the multistage piston compressor according to the invention, independent and individually operable compressor stages can hence be achieved given a shared drive train. As a consequence, connecting the liquid column of hydraulic fluid powered by the piston according to the invention readily enables a partial load operation of a corresponding compressor stage. In addition, connecting the liquid column with an outlet makes it possible to deactivate one or more compressor stages, in which the corresponding compressor pistons have been immobilized and shut down, and do not perform any motions in the compressor cylinders. Shutting down or varying the compressor stroke of the corresponding compressor pistons leads to improved energy efficiency, since no drive power needs to be applied for the deactivated piston, or changing the corresponding compressor stroke of the compressor piston places a uniform load on the drive train in a partial load range. In addition, shutting down the compressor piston reduces or avoids mechanical wear on the surfaces between the pistons and compressor cylinders, the seals of the piston, and the inlet and outlet valve of the medium of a no-load compressor stage.

In a preferred embodiment of the invention, a valve arrangement is provided for connecting the liquid column with the outlet. A corresponding valve arrangement can be used to easily control the process of connecting the liquid column powered by the piston drivingly linked with the drive train with the outlet, so that the valve arrangement conveys the liquid column powered by the piston to the outlet, so as to partially or completely deactivate the compressor cylinder allocated to the piston.

In one embodiment of the invention, it is especially advantageous that the compressor cylinders be connected by means of a respective branching outlet line with a collecting outlet line, wherein the valve arrangement is situated in the branching outlet line. A collecting outlet line and a corresponding branching outlet line provided with a valve arrangement can be used on a multistage piston compressor at each compressor stage to easily control the process of individually connecting the liquid column of hydraulic fluid of each compressor stage with the outlet, so as to partially or completely deactivate the corresponding compressor piston of the compressor stage.

The valve arrangement is best designed as a control valve, in particular a slide valve or ball valve, with a locked position and a flow position. Through corresponding actuation, such a control valve can be used to easily connect the liquid column with the outlet in the direction of the flow position, with the goal of having the piston powered by the drive train convey the liquid column to the outlet, so as to control the motion and compressor stroke of the compressor piston.

The ability to actuate the valve arrangement with an electronic controller yields special advantages. By correspondingly actuating the valve arrangements, an electronic controller can be used to easily control the behavior of the compressor.

The collecting outlet line is best connected with a container, in particular a container exposed to a pretension pressure. A container exposed to a pretension pressure causes the liquid column to be conveyed from the powered piston to the container with the valve arrangement open under a certain counter-pressure. As an alternative, a specific pretension pressure in the collecting outlet line can be achieved by means of an overflow valve in the collecting outlet line.

A further development of the invention yields special advantages if at least one additional valve arrangement is situated in the collecting outlet line or branching outlet line. Additional valve arrangements make it easy to influence and/or control the behavior of the compressor.

In one embodiment of the invention, the additional valve arrangement can be designed as an overflow valve, in particular a pressure relief valve. A pressure relief valve in the corresponding branching outlet line makes it possible to secure the input pressure and/or output pressure of the corresponding compressor stage, so that the corresponding compressor stage can adjust to an altered input pressure and/or output pressure.

In another embodiment of the invention, the additional valve arrangement can be designed as a pressure control valve and/or flow limiting valve. Such an additional valve arrangement makes it easy to allow a partial load deactivation of the corresponding compressor stage.

In an advantageous embodiment of the invention, the drive train encompasses a crank or eccentric shaft powered by a drive motor, wherein the pistons are connected with the crank shaft by means of a respective connecting rod. The piston compressor can here be designed as a linear compressor, in which the pistons execute a pure linear motion in the compressor cylinder, and the connecting rod is arranged on the crank shaft by means of a mount. As an alternative, the compressor according to the invention can exhibit a swiveling piston configuration, in which the pistons carry out a pendulum movement in the compressor cylinder, and the connecting rod can be rigidly secured to a crank or eccentric shaft.

In a preferred further development of the invention, the liquid column can be linked with a supply source. A supply source can be used to easily refill the liquid column of the corresponding compressor stage, thereby making it possible to connect the compressor stage. A supply source also makes it possible to easily change out the hydraulic fluid and ventilate the liquid column.

The supply source best encompasses a supply pump linked with the container, which conveys by way of a supply line, wherein the compressor cylinders are connected by the respective branching supply line with a supply line, wherein the branching supply line incorporates a respective valve arrangement. A valve arrangement in corresponding branching supply lines makes it easy to refill the liquid column of the allocated compressor stage via the supply pump that feeds into the supply line.

In a possible embodiment of the invention, the compressor stages in a piston compressor according to the invention are connected in series. A stage compressor in which at least two compressor stages are connected in series, with the output of a compressor stage being connected with the input of another compressor stage, easily enables a partial load operation of a compressor stage via the connection of one or all compressor stages with the outlet as described in the invention. As a result, a uniform load is placed on the drive train. In addition, it allows the corresponding compressor stage to adapt to varying input or output pressures, so that the piston compressor according to the invention can be operated within a wide range of input and output pressures.

In another possible embodiment of the invention, the compressor stages are connected in parallel. In such a piston compressor, in which each compressor stage constitutes a separate compressor and provides a corresponding delivery capacity for the compressed medium, partially or completely deactivating the individual compressor stages as described in the invention makes it possible to easily provide a variable and adjustable delivery capacity. Connecting the corresponding liquid column of the allocated compressor stage according to the invention makes it easy to realize a multiple compressor solution for variable delivery capacity with a shared drive train. The partially or completely deactivated compressor stages here each comprise separate, stand-alone compressors. If such a multistage piston compressor requires a higher delivery capacity, additional compressor stages can be sequentially connected. In addition, the compressor according to the invention makes it possible to optimally utilize the installed engine output of the drive motor. If the counter-pressure of the compressed medium is low at the output, several compressor stages can be operated simultaneously. Given a higher counter-pressure at the output or during booster operation, the individual compressor stages can easily be disconnected to enable an adjustment to the engine output.

Connecting the liquid column of the corresponding compressor stage with the outlet as described in the invention further makes it possible to individually operate selected compressor stages in the case of a multistage compressor according to the invention. This enables the operation of selected compressor stages without the other compressor stages having to be operational, for example given a malfunction of a compressor stage. Given a failure or malfunction of one or more compressor stages in a multistage compressor according to the invention, the affected compressor stages can be switched off, and the compressor can continue to be operated with the functional compressor stages.

The piston compressor according to the invention can be designed in such a way that the compressor pistons operated by means of the liquid column are in direct contact with the medium to be compressed, and compress the medium. In a preferred further development of the invention, the compressor is designed as an ionic compressor, wherein the compressor piston of the corresponding compressor stage is in contact with a liquid column of an ionic operating liquid that is situated in the compressor cylinder, and used to compress the medium. Such ionic compressors displace the medium to be compressed from the ionic liquid column into the compressor cylinder, and are preferably used for compressing gaseous media, for example hydrogen.

A multistage piston compressor according to the invention makes it possible to connect the liquid column with the outlet so as to be able to partially or completely deactivate a compressor stage or several compressor stages as the drive train continues to run. The partial deactivation of individual compressor stages easily enables the partial load operation of selected compressor stages. The complete deactivation of individual compressor stages permits the adjustment of the compressor output to the installed engine output of the drive motor of the drive train and/or achievement of a variable compressor power. In addition, completely deactivating individual compressor stages allows the compressor to keep operating given a disrupted or inoperative compressor stage.

Furthermore, a multistage piston compressor according to the invention makes it possible to connect liquid columns of all compressor stages with the outlet so as to initiate an emergency shutdown of the compressor as the drive train continues to run. In the case of a multistage piston compressor according to the invention, all liquid columns of the compressor stages can be simultaneously connected with the outlet to realize an emergency load shedding, in which all compressor stages are deactivated without having to immediately bring the drive train to a standstill.

Additional advantages and details of the invention will be explained in greater detail based on the exemplary embodiments depicted on the schematic figures. Shown on:

BRIEF DESCRIPTION OF THE DRAWINGS

FIG. 1 shows a multistage piston compressor 1 according to the invention, which in the present exemplary embodiment encompasses four compressor stages A, B, C, D.

DETAILED DESCRIPTION OF THE INVENTION

Figure 1:
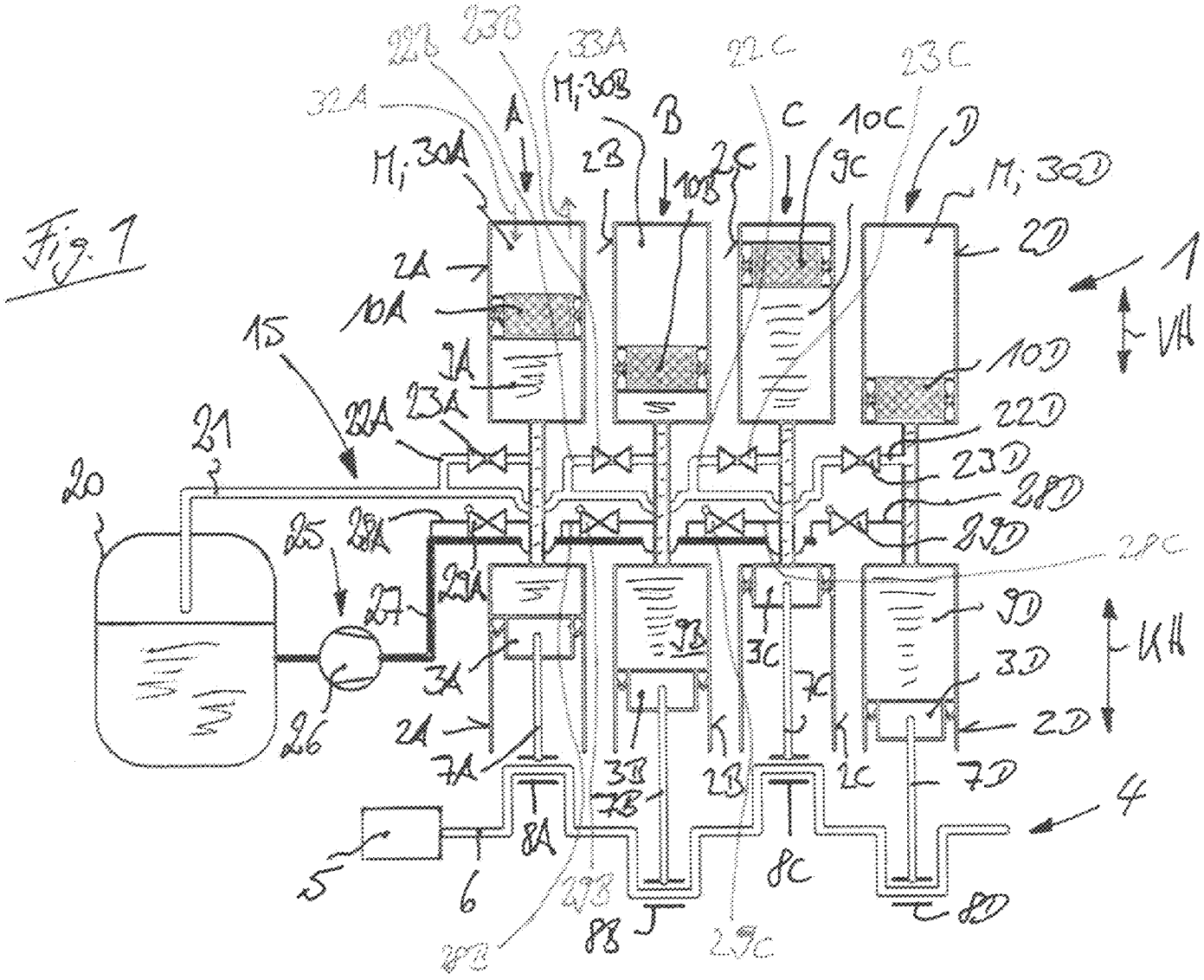
FIG. 1 is a schematic representation of a multistage piston compressor according to the invention, and on FIG. 2 is a further development of the multistage piston compressor.

Each compressor stage A, B, C, D encompasses a piston 3A, 3B, 3C, 3D situated in a compressor cylinder 2A, 2B, 2C, 2D so that it can shift longitudinally. The pistons 3A-3D are drivingly linked with a shared drive train 4 in order to jointly power the pistons 3A-3D.

In the exemplary embodiment shown, the drive train 4 consists of a crank or eccentric shaft 6 powered by a drive motor 5, for example an electric motor or combustion engine, wherein the pistons 3A-3D are each mechanically connected with the crank shaft 6 by means of a connecting rod 7A-7D. A mount 8A-8D can be incorporated where the connecting rod 7A-7D is hinged to the crank or eccentric shaft 6.

According to the invention, each piston 3A-3D is connected by means of a liquid column 9A-9D consisting of an incompressible medium, for example a hydraulic fluid, in the compressor cylinder 2A-2D with a compressor piston 10A-10D, which can be longitudinally shifted in the compressor cylinder 2A-2D and is used to compress the medium M to be compressed, for example gaseous or liquid hydrogen, either directly or with the insertion of a liquid column of ionic operating liquid 30A-30D. Schematically depicted sealing arrangements are used to seal the piston 3A-3D away from the corresponding compressor cylinders 2A-2D.

Given a powered drive train 4, the kinematics of the crank shaft 6 and connecting rod 7A-7D lead to a predetermined, constant piston stroke KH between the upper lower dead point of the corresponding pistons 2A-2D of the respective compressor stages A-D.

According to the invention, the receptive liquid column 9A-9D of the allocated compressor stage A-D can further be connected with an outlet 15.

Provided for this purpose is a collecting outlet line 21, which is routed to a container 20, and connected to the respective compressor cylinders 2A-2D by a respective one corresponding branching outlet line 22A-22D. Each branching outlet line 22A-22D incorporates a an outlet line valve 23A-23D in order to control the process of connecting the liquid column 9A-9D with the collecting outlet line 21, and hence to correspondingly drain hydraulic fluid of the allocated liquid column 9A-9D. The container 20 can be exposed to a slight pretension. 22B and 22C represent branching outlet lines for compressor stages B and C and 28B and 280 represent branching supply lines for compressor stages B and C. 23B and 23C and 29B and 29C represent valve arrangements for compression stages B and C.

The outlet line valve 23A-23D can be designed as a slide valve or ball valve, which can be actuated between a flow position and locked position.

Provided for refilling hydraulic fluid from the container 20 into the corresponding liquid column 9A-9D of compressor stages A-D is a supply source 25, which exhibits a supply pump 26 that is connected with the container 20 on the suction side, and conveys into a supply line 27 on the pressure side. The compressor cylinders 2A-2D are each connected by means of a branching supply line 28A-28D with the supply line 27. A respective supply line valve 29A-29D is situated in the supply lines 28A-28D for correspondingly filling hydraulic fluid in the allocated liquid column 9A-9D. The valve arrangement 29A-29D can be designed as a slide valve or ball valve, which can be actuated between a flow position and locked position.

Hydraulic fluid can be drained from the corresponding liquid column 9A-9D by correspondingly actuating the outlet line valve 23A-23D, so that given a predetermined and constant piston stroke KH of the allocated piston 3A-3D toward the top on FIG. 1, the flowing pressure exerting means in the form of the hydraulic fluid of the liquid column 9A-9D being conveyed in the compressor cylinder 2A-2D is partially or completely conveyed to the outlet 15 with the outlet line valve 23A-23D opened, and hence into the container 20. When the outlet line valve 23A-23D is opened, the hydraulic fluid conveyed by the mechanically powered piston 3A-3D is prevented from not or only partially getting to the allocated compressor piston 10A-10D, and a corresponding movement is imparted to the compressor piston 10A-10D. This diversion of conveyed hydraulic fluid in the liquid column 9A-9D into the collecting outlet line 21 makes it possible to switch the affected compressor stage A-D, and hence the compressor piston 10A-10D, partially or completely to no load, and thereby render it motionless. The drive train 4 can here continue to run, and power the additional compressor stages.

As a consequence, connecting the liquid column 9A-9D of the respective compressor stage A-D with the outlet 15 as described in the invention makes it possible to vary and change the compressor stroke VH of each compressor piston 10A-10D independently of the constant piston stroke KH of the allocated piston 3A-3D, wherein the compressor piston 10A-10D can further be shut down completely with the compressor stroke VH at zero. Therefore, controlling the liquid column 9A-9D with the outlet 15, and hence the container 20, enables the partial or complete deactivation of a compressor cylinder 10A-10B. Individually activating the outlet line valve 23A-23D further makes it possible to control and change the compressor stroke VH of each compressor piston 10A-10D independently of the compressor stroke of the other compressor pistons of the other compressor stages.

Figure 2:
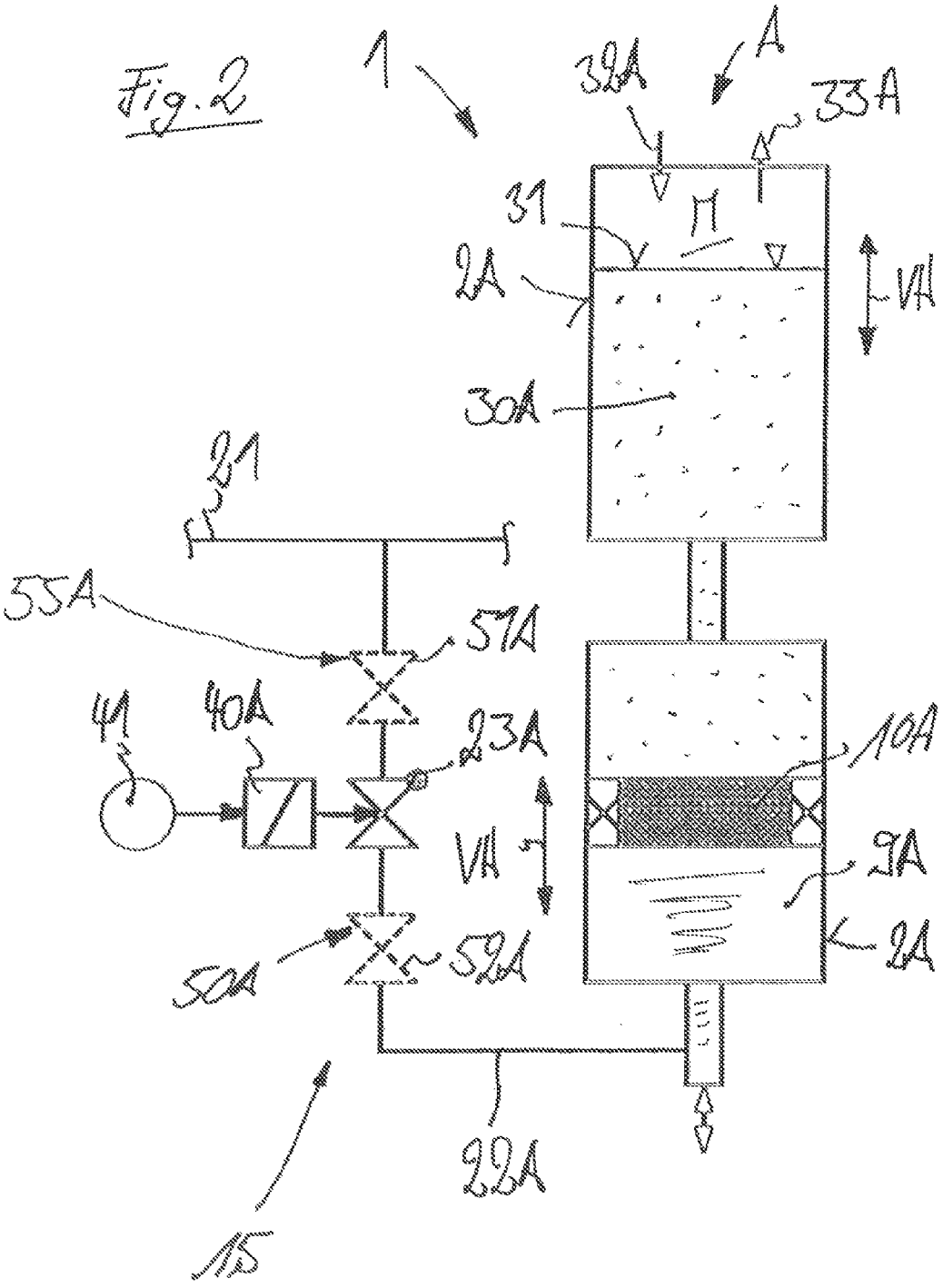

FIG. 2 illustrates a further development of the invention based on a compressor stage A of the compressor 1 according to the invention. The other compressor stages B-D of the compressor 1 according to the invention can be correspondingly designed.

According to FIG. 2, the compressor 1 is designed as an ionic compressor 1, wherein the compressor piston 10A designed as a phase separator, which is moved by the hydraulic fluid and hence the liquid column 9A-9D, is in contact with a liquid column of an ionic operating liquid 30A that is situated in the compressor cylinder 2A, and performs a compressor stroke at the fill level 31 corresponding to the compressor stroke VH of the compressor piston 10A. The ionic operating liquid 30A is used to compress the medium M, which is located in a displacement space created by the compressor cylinder 2A and ionic operating liquid 30A. An inlet valve 32A and outlet valve 33A at the compressor cylinder 2A can be used to aspirate and eject the medium M.

FIG. 2 further shows an electrical activation device 40A, for example a magnet or electric actuator, for the outlet line valve 23A situated in the branching outlet line 22A. The outlet line valve 23A can be activated by means of an electronic controller 41, which is connected with the activation device 40A for this purpose.

According to FIG. 2, at least one additional valve 50A or 55A is arranged in the branching outlet line 22A. In the present exemplary embodiment, an overflow valve 51A, for example a pressure relief valve, and a control valve 52A, for example a pressure control or pressure relief valve, are situated in the branching outlet line 22A as an additional valve 50A or 55A.

There are a series of advantages associated with a multistage compressor 1 according to the invention.

In the multistage piston compressor 1 according to the invention, independent compressor stages A-D can be achieved given a shared drive train 4 with a single drive motor 5. In the multistage piston compressor 1 according to the invention with a shared drive train 4, individual compressor stages A-D can be partially or completely deactivated, and thereby operated under partial load or no load conditions, or individual compressor pistons can be rendered motionless. This yields improved energy efficiency and a reduced load for the drive with the compressor stage deactivated. In addition, a reduced load and less mechanical wear are achieved in an immobilized compressor piston of a compressor stage, for example on the seals of the compressor piston and the surfaces of the compressor piston as well as the compressor cylinder, and the valves of the compressor stage.

Partially or completely decoupling individual compressor stages from the drive train further results in an elevated energy efficiency during partial load operation. In addition, this makes it possible to maintain a uniform load on the drive train.

Furthermore, individually deactivating the separate compressor stages as described in the invention allows the compressor 1 to adjust to altered input and output pressures of the medium to be compressed. As a consequence, in a multistage piston compressor according to the invention designed as a stage compressor, this permits operation in an expanded input pressure range, and a variable compression ratio on the corresponding compressor stages.

Situating one or more additional outlet line valves in the branching outlet lines of the corresponding compressor stage makes it possible to easily influence and/or control the behavior of the compressor. One or more deactivation variants (partial load, pressure relief, complete shutdown) for the corresponding compressor stage can be readily enabled by arranging an overflow valve, for example a pressure relief valve, or and/or a control valve, for example a pressure control valve or flow control valve, in the corresponding branching outlet line of a compressor stage.

What we claim is:

1. A multistage ionic piston compressor for a gaseous or cryogenically liquefied medium with at least two compressor stages, which operatively interact with a shared drive train for purposes of joint powering, wherein each compressor stage exhibits a piston that is mechanically connected with the drive train, and arranged in a compressor cylinder so that it can longitudinally shift, characterized in that the piston of the respective compressor stage is in contact with a first liquid column of an incompressible liquid situated in the compressor cylinder, which converts a piston stroke motion of the piston into a motion of a compressor piston arranged in an upper portion of the compressor cylinder so that it can longitudinally shift, wherein the first liquid column of the incompressible liquid is arranged in the compressor cylinder between the piston and the compressor piston, and that the compressor piston of the respective compressor stage is in contact with a second liquid column of an ionic operating liquid that is situated in the compressor cylinder, wherein the second liquid column of the ionic operating liquid is arranged in the compressor cylinder on the top of the compressor piston and wherein the second liquid column of the ionic operating liquid is in direct contact with the medium and used to compress the medium, wherein the compressor piston is designed as a phase separator separating the first liquid column and the second liquid column, wherein the first liquid column for changing a compressor stroke of the compressor piston can be connected with an outlet.

2. The multistage piston compressor according to claim 1, characterized in that a valve is provided for connecting the first liquid column with the outlet.

3. The multistage piston compressor according to claim 2, characterized in that the compressor cylinders are connected by means of a respective branching outlet line with a collecting outlet line, wherein the valve is situated in the branching outlet line.

4. The multistage piston compressor according to claim 2, characterized in that the valve is designed as a control valve, a slide valve or ball valve, with a locked position and a flow position.

5. The multistage piston compressor according to claim 2, characterized in that the valve can be actuated with an electronic controller.

6. The multistage piston compressor according to claim 3, characterized in that the collecting outlet line is connected with a container.

7. The multistage piston compressor according to claim 3, characterized in that at least one additional valve is situated in the collecting outlet line or branching outlet line.

8. The multistage piston compressor according to claim 7, characterized in that the additional valve is designed as an overflow valve.

9. The multistage piston compressor according to claim 7, characterized in that the additional valve is designed as a control valve.

10. The multistage piston compressor according to claim 7, characterized in that the additional valve is designed as a flow limiting valve.

11. The multistage piston compressor according to claim 1, characterized in that the drive train encompasses a crank or eccentric shaft powered by a drive motor, wherein the pistons are connected with the crank or eccentric shaft by means of a respective connecting rod.

12. The multistage piston compressor according to claim 1, characterized in that the first liquid column is connected with a supply source.

13. The multistage piston compressor according to claim 12, characterized in that the supply source encompasses a supply pump linked with the container, which conveys by way of a supply line, wherein the compressor cylinders are connected by the respective branching supply line with the supply line, wherein the branching supply line incorporates a valve.

14. The multistage piston compressor according to claim 6 characterized in that said container is a container exposed to a pretension pressure.

15. The multistage piston compressor according to claim 8 characterized in that said overflow valve is a pressure relief valve.

* * * * *